US006401642B1

(12) United States Patent
Handte et al.

(10) Patent No.: US 6,401,642 B1
(45) Date of Patent: Jun. 11, 2002

(54) METHOD AND DEVICE FOR FOLDING ROUND POCKETS

(75) Inventors: Werner Handte; Herbert Pfleger, both of Kaiserslautern; Axel Zinssmeister, Rothselberg, all of (DE)

(73) Assignee: G.M. Pfaff Aktiengesellschaft In Insolvenz (DE)

( * ) Notice: Subject to any disclaimer, the term of this patent is extended or adjusted under 35 U.S.C. 154(b) by 0 days.

(21) Appl. No.: 09/868,429

(22) PCT Filed: Dec. 17, 1999

(86) PCT No.: PCT/EP99/10038

§ 371 (c)(1),
(2), (4) Date: Jun. 15, 2001

(87) PCT Pub. No.: WO00/35306

PCT Pub. Date: Jun. 22, 2000

(30) Foreign Application Priority Data

Dec. 17, 1998 (DE) ..... 198 58 181

(51) Int. Cl.[7] ..... D05B 21/00; D05B 35/04

(52) U.S. Cl. ..... 112/470.16; 112/475.06; 112/475.09

(58) Field of Search ..... 112/470.14, 470.16, 112/470.17, 470.15, 470.26, 470.33, 475.06, 475.09; 223/37, 38

(56) References Cited

U.S. PATENT DOCUMENTS

| | | | | | |
|---|---|---|---|---|---|
| 5,133,271 | A | * | 7/1992 | Iwasaki et al. | 112/114 |
| 5,188,044 | A | * | 2/1993 | Brockmann | 112/104 |
| 5,809,920 | A | * | 9/1998 | Zantopp et al. | 112/147 |
| 6,123,042 | A | * | 9/2000 | Visi | 112/114 |

FOREIGN PATENT DOCUMENTS

| | | | |
|---|---|---|---|
| DE | 1660924 | * | 2/1972 |
| DE | 4008148 | * | 9/1990 |
| GB | 1449836 | * | 9/1976 |

* cited by examiner

*Primary Examiner*—Ismael Izaguirre
(74) *Attorney, Agent, or Firm*—McGlew and Tuttle, P.C.

(57) ABSTRACT

A process for folding or folding over pockets with round edge sections is provided along with a device for carrying out the process. Round folding slides (9; 53), provided with concave folding edges (49; 54), are either moved or designed such that their ends (50, 51; 55), either one after another or simultaneously, lead in relation to the middle area of the concave folding edges (49; 54). An especially intense folding effect is thus exerted on the transition areas between the round and straight pocket edge sections and a pocked folded edge that is uniform on all sides is thus obtained.

13 Claims, 2 Drawing Sheets

METHOD AND DEVICE FOR FOLDING ROUND POCKETS

FIELD OF THE INVENTION

The present invention pertains to a process and a folding device for folding or folding over the edges of the pocket cuts with round edge sections during the preparation of pockets sewn on pieces of garments using a folding device arranged on a sewing unit with a pocket support plate, which folding device can be moved up and down as well as forward and backward in relation to a fabric support plate, with a pressing plate, which can be moved up and down, as well as with a plurality of the folding slides, which can be moved up and down together with the pressing plate and can be moved forward and backward individually or together, of which the round folding slides used to form the round edge sections have a concave folding edge

BACKGROUND OF THE INVENTION

A folding device for folding over the edges of pockets of various shapes has been known from DE-PS 1 660 924. In DE-PS 1 660 924 a folding device is disclosed in FIG. 10 for folding over pockets with a round edge section, which has folding slides with a folding edge extending in a straight line for folding over the straight edge sections and round folding slides with a concave folding edge for folding over the round edge sections. The radius of this folding edge corresponds to the radius of the round edge section of the pocket to be formed. It was found that an unsatisfactory result is obtained with folding device of such a design insofar as deviations from the desired arc shape will occur during folding, especially at the transitions between the straight and arc-shaped edge sections in the area of round edge sections because of the material gatherings occurring there, besides nonuniformly formed creases, due to the fact that bulges of the folded edge, which bulges are folded in incompletely, are left, which lead to nonuniform seams in this area and consequently to an unattractive appearance of the pocket sewn on. The smaller the radius of the round edge section, the more marked will be such irregularities and disturbances.

A folding device for folding or folding over pockets, which has a pocket support plate that can be moved forward and backward, a pressing plate that can be moved up and down, and a plurality of folding slides, which can be moved forward and backward and are arranged on a frame that can be moved up and down, has been known from DE 40 08 148 C2 (corresponding to U.S. Pat. No. 5,058,517). L-Shaped elastic clamping pieces are fastened to the folding slides, and these clamping pieces generate an increased clamping force acting on the pocket support plate located between them, the pocket cut and the pressing plate together with the folding slides when they are moving forward together into the folding position. A clean folding result is thus obtained even when the difference in the levels of the folding slides and the pocket support plate is not exactly adjustable. Moreover, pocket cuts with round edge sections can also be folded accurately. Folding slides arranged at an angle of 45° with a concave folding edge and with a clamping piece each are associated with the round corner areas of the pocket cut for this purpose. However, no reference can be found on how the material gatherings occurring there are uniformly distributed; at any rate, an increased clamping force is not a remedy.

Pocket shapes with round edge sections can be found, e.g., in the prospectus Adler-Automation 802-20/ZE 2-2 (1973). However, there is no reference to any measure for solving the problem of material gatherings occurring in the case of round edge section and the corresponding sewing unit does not have such an embodied measure, either.

SUMMARY AND OBJECTS OF THE INVENTION

The basic object of the present invention is to provide a process and a folding device by which the material gatherings occurring in the area of the round edge sections are uniformly distributed.

According to the invention, a process is provided for folding or folding over the edges of the pocket cuts with round edge sections during the preparation of pockets sewn on pieces of garments using a folding device arranged on a sewing unit. The sewing unit has a pocket support plate, which can be moved up and down as well as forward and backward in relation to a fabric support plate. A pressing plate is provided which can be moved up and down. A plurality of folding slides can be moved up and down together with the pressing plate and can be moved forward and backward individually or together. Round folding slides used to form the round edge sections have a concave folding edge. During the forward movement into the folding position, the round folding slides lead with at least one of the two ends of their concave folding edges in relation to the middle area of the folding edges.

According to a further aspect of the invention, a folding device is provided for carrying out the process. During the folding operation, at least one end of the concave folding edges of the round folding slides has a shorter distance from the respective associated convex folding edge of the said pocket support plate than the rest of the area of the concave folding edges.

Due to the measure taken in the process according to the invention and with the features of the device according to the invention, a more intense folding effect is exerted on the transition areas of the round edge sections to the straight edge sections than on the other areas of the round edge sections. It is thus achieved that these edge areas of pockets with round edge sections, which were problematic before, will also be folded over correctly, as a result of which a uniform seam will now be obtained over the entire course of the seam of the pocket sewn on.

In a variant of the process, the round folding slides are moved forward into the folding position one after another in different angular positions. Since one of the ends of the concave folding edges of the round folding slides thus has a shorter distance from the associated folding edge of the pocket support plate, the corresponding transition area of the round edge sections to the straight edge sections is folded over first during the feed motion of the round folding slides until the rest of the area of the round edge sections including the other transition area is finally folded over as well. After all folding slides are in their folding position and lie on the piece of clothing due to being lowered together with the pressing plate, only the round folding slides are retracted from the folding position, pivoted into the other angular position and are then again moved forward into their folding position. Since the other ends of the concave folding edge now have a shorter distance from the convex folding edge of the pocket plate, the other transition areas are now also folded over more intensely during the second folding operation, so that all transition areas are folded in to an increased extent to conclude the entire folding operation.

The folding effect of the ends of the concave folding edges, which ends are pivoted forward, is also supported by the possibility that the movement of the round folding slides may take place at a steeper angle in relation to the straight edge section joining the corresponding transition area than in the case of the usual round folding slides moved at an angle of 45°.

A comparatively simple device embodiment of the process may be formed by a corresponding shape of the folding edge of the round folding slides.

The possible further measures of the invention provide additional contributions to the optimal solution to the problem, namely, that the material gatherings occurring in the area of the round edge sections be distributed uniformly.

The number and the position of the creases formed during the folding over are determined by the notches on the folding edge, as a result of which uniform appearance of the two round edge sections of the same pocket but also of all other pockets is achieved.

It may be achieved that the areas of the pocket cuts adjoining the pocket cut edges to be folded over will be held absolutely securely during folding over, so that satisfactory clean folded edges, which also have a correct course corresponding to the pattern in the case of patterned fabrics, are obtained without the risk of a unilateral stretching of the pocket.

The use of a heating device within the pressing plate can provide an ironing effect, which stabilizes the shape and the position of the folded edges of the pocket cut, is exerted on the folded edges, so that the result of the folding is improved, especially also in the area of the round edge sections.

A measure may be provided to additionally improve the result of the folding in the case of differences in the thickness of the piece of clothing and/or of the pocket cut, which are caused by the number of fabric layers being different.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
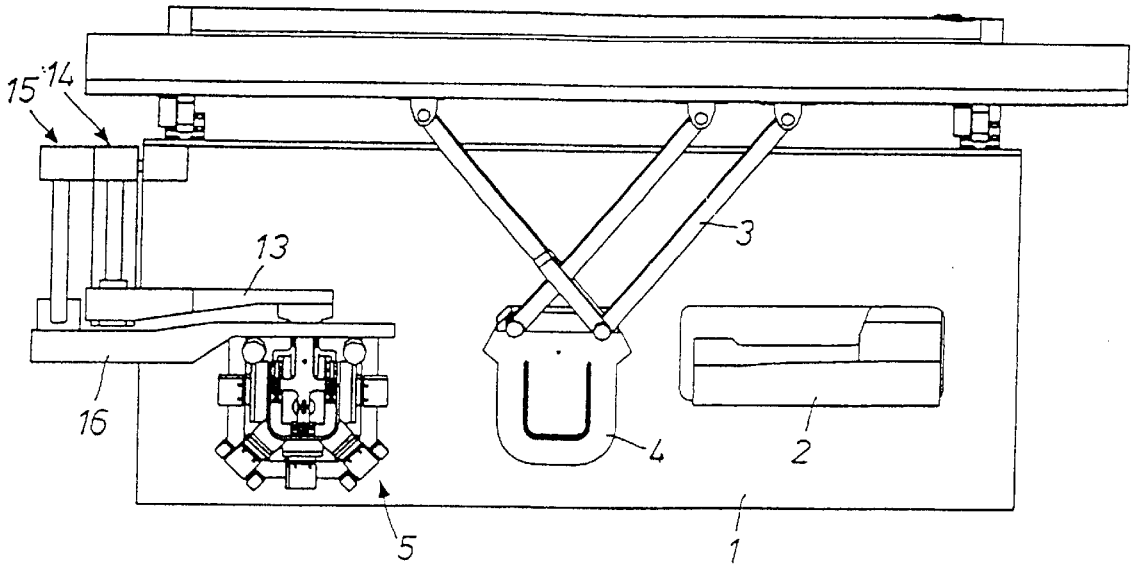
FIG. 1 is a top view of a sewing unit according to the invention.

Referring to the drawings in particular, the sewing unit shown in FIG. 1 has a fabric support plate 1, a sewing machine 2 and a guide 3 for a fabric holder 4. The fabric holder 4 can be moved to and fro between the sewing machine 2 and a folding device 5 by means of the guide 3. Furthermore, the fabric holder 4 can move up and down. The driving device used for this purpose corresponds to the comparable device 5 disclosed in the German Patent Application 198 40 749.1.

The folding device 5 comprises in the known manner essentially a pocket support plate 6, a pressing plate 7, three straight folding slides 8 and two round folding slides 9 and 53, respectively.

The pocket support plate 6 has, corresponding to the shape of the pocket, straight folding edges 10 and convex folding edges 11 and is provided with a flatly extending bevel 12 in the area of these folding edges. The pocket support plate 6 is detachably fastened to a carrier rod 13, which is part of a bracket 14. The pocket support plate 6 can be moved up and down as well as forward and backward by the bracket 14, to which drive elements, not shown in the drawing, belong. The bracket 14 otherwise corresponds to the bracket 17 described in detail in the above-mentioned German Patent Application 198 40 749.1.

An additional bracket 15, which corresponds to the bracket 6 described in the above-mentioned German Patent Application, is associated with the folding device 5. The bracket 15 has a carrier rod 16. An essentially U-shaped frame 17 and a cross-shaped carrier plate 18 are fastened to the carrier rod 16.

The above-mentioned pressing plate 7, which has a U shape in this folding device 5, is arranged at the ends of three arms of the carrier plate 18 via a height-adjustable coupling mechanism 19 each. Each of the three coupling mechanisms 19 has a housing 20, which is open on the lower front side and is rigidly connected to a threaded pin 21. The threaded pin 21 is firmly screwed into a threaded sleeve 22, which is in turn screwed adjustably into the carrier plate 18. The vertical screwed-in position of the threaded sleeve 22 is secured by a lock nut 23. A piston 24 is pressed against a securing ring 26 acting as a stop by means of a compression spring 25. The piston 24 is displaceably accommodated in the interior space of the housing 20. A connection plate 29, which is in turn fastened to the pressing plate 7 by means of screws 30, is fastened to a hollow attachment 27 of the piston 24 by means of a countersunk head screw 28.

The surface 31 of the pressing plate 7 facing the pocket support plate 6 likewise extends obliquely corresponding to the bevel 12. An electromagnet 32 is adjustably fastened to the carrier plate 18. A screw 33 screwed firmly into the magnet 32 can be locked for this purpose in its axial position relative to the carrier plate 18 by two lock nuts 34, as a result of which the vertical distance between the lower front surface of the magnet 32 and the plane of the surface 31 of the pressing plate 7 can be adjusted.

The pressing plate 7 has a downwardly projecting folding strip 35, which limits the surface 31 and whose course is adapted to the shape of the pocket support plate 6. An electrically operated heating cartridge 37 is arranged in each of two holes 36 of the pressing plate 7.

A total of five compressed air cylinders 38, each of which having a piston rod 39, are arranged on the frame 17. A carrier 40, which is secured against tilting by means of two guide rods 41 displaceably accommodated in the cylinder housing, is fastened to the piston rod 39 of each cylinder 38.

Three of the cylinders 38 are rigidly arranged at the straight sections of the U-shaped frame 17. Each one of the straight folding slides 8 already mentioned above, which has a straight folding edge 42, is fastened to the associated one of the carriers 40 of these three cylinders 38.

The other two cylinders 38 are arranged pivotably in the corner areas of the U-shaped frame 17, with each cylinder 38 being held by a screw 43 only. The screw 43 also forms the axis of rotation of the cylinder 38. Instead of the other screw, a pin 44, which engages an elongated hole 45 of the respective cylinder 38, is fastened in the frame 17. Each of the other two cylinders 38 has a short-stroke cylinder 47. The pin-shaped piston rod 48 of each cylinder 47 engages the outside of the housing of the cylinder 38 arranged between them. The cylinders 47 are each arranged on an angle member 46 fastened to the frame 17.

One of the round folding slides 9 already mentioned above, which have a concave folding edge 49, is fastened to the carrier 40 of each of the two pivotable cylinders 38. The left-hand end of the concave folding edge 49 is designated by 50 and the right-hand end by 51. On the top side, the round folding slides 9 have a plurality of notches 52, which start from the folding edge 49 and extend essentially radially in relation to the arc shape of the folding edge 49.

Figure 6:
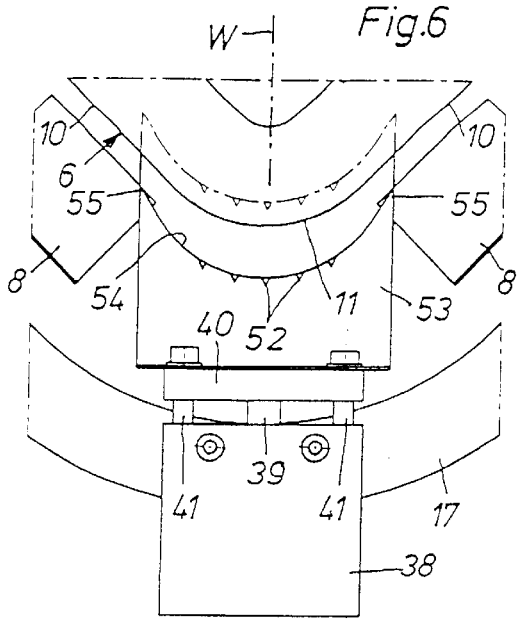
FIG. 6 is a top view of a round folding slide and its drive element in the second exemplary embodiment.

In the second exemplary embodiment according to FIG. 6, the cylinders 38 arranged in the corner areas of the U-shaped frame 17 are arranged rigidly, and their direction of movement is in the bisectrix W between two straight folding edges 10 of the pocket support plate 6. A round folding slide 53 each, whose concave folding edge 54 has a smaller radius than the associated convex folding edge 11 of the pocket support plate 6, is fastened to the carrier 40 of these two cylinders 38. The two ends 55 of the concave folding edge 54 thus have a shorter distance from the convex folding edge 11 than the middle area of the folding edge 54 in the starting position shown in FIG. 6.

The Mode of Operation is as Follows:

A piece of clothing is positioned manually on the fabric support plate 1 under the pocket support plate 6. A pocket cut T is positioned manually on the pocket support plate 6 located in the pushed-forward position and is aligned, if necessary, in such a way as to match the pattern of the piece of clothing.

Figure 3:
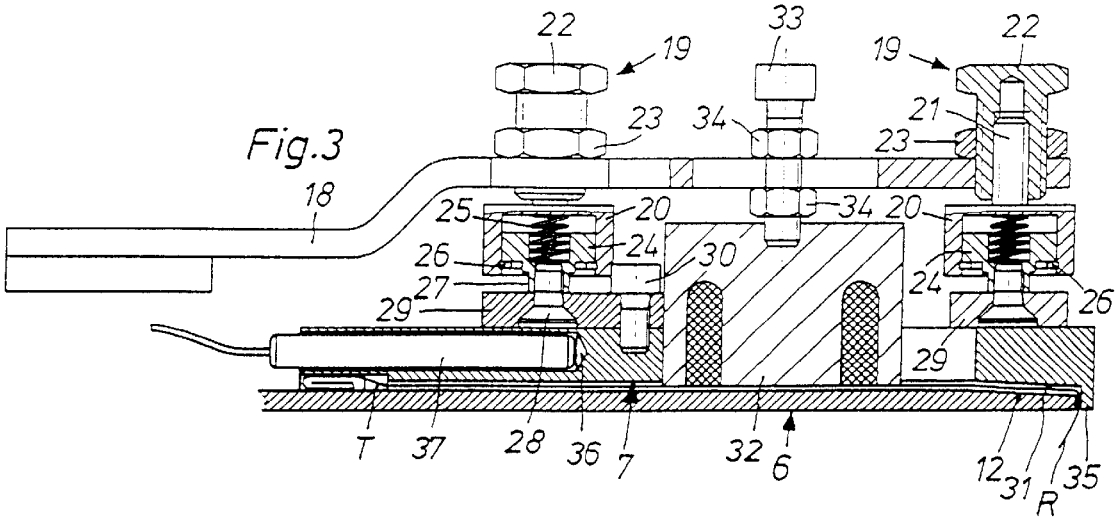
FIG. 3 is a sectional view of the folding device along line III—III in FIG. 2.
Figure 4:
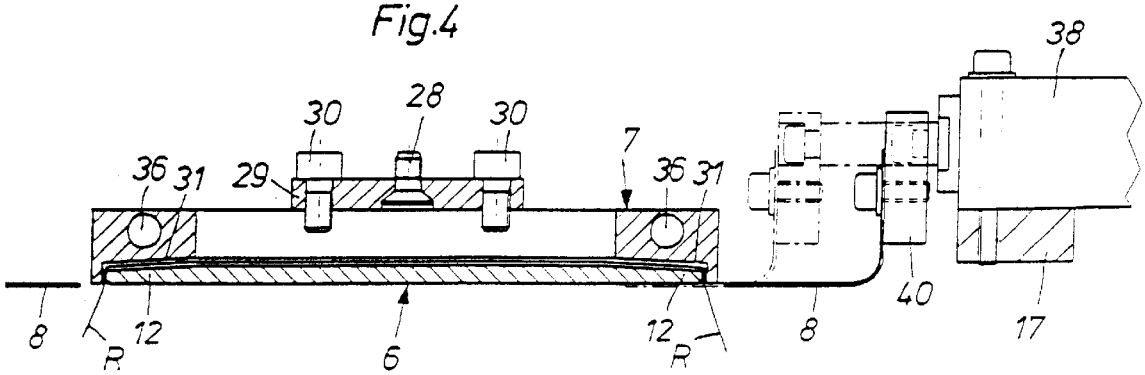
FIG. 4 is a sectional view of the folding device along line IV—IV in FIG. 2.

The carrier rod 16 is then lowered to the extent that the pressing plate 7 lies on the pocket cut T and folds the edge sections R projecting over the folding edges 10, 11 of the pocket support plate 6 in the downward direction by means of the folding strip 35, as is shown in FIGS. 3 and 4. The electromagnet 32 is subsequently energized, as a result of which it pulls the pocket support plate 6 firmly against the pressing plate 7. The pocket cut T is thus firmly clamped between the bevel 12 of the pocket support plate 6 and the surface 31 of the pressing plate 7, as a result of which the part of the pocket cut T located on the pocket support plate 6 cannot be stretched during the subsequent folding operation.

Figure 2:
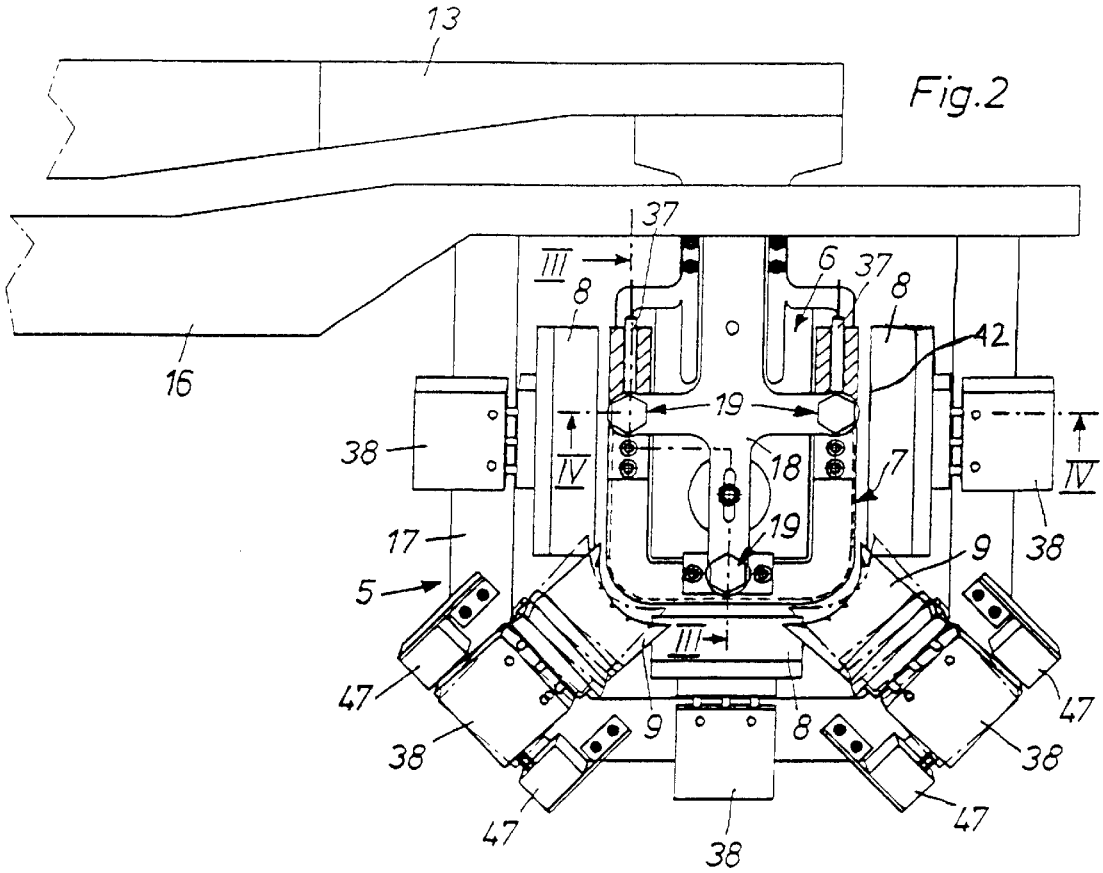
FIG. 2 is a top view of the folding device according to the invention.
Figure 5:
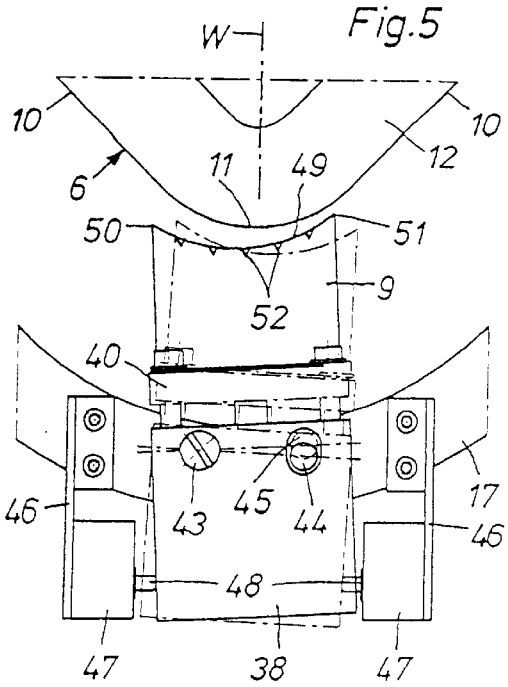
FIG. 5 is a top view of a round folding slide and its drive and adjusting elements.

Pressure is now admitted to all five cylinders 38 and the straight folding slides 8 and round folding slides 9 are moved forward into the folding position, as a result of which the edge sections R are folded over onto the underside of the pocket support plate 6. During this folding operation, the two cylinders 38 arranged in the corner areas are in the pivoted position shown in FIG. 2, which deviates by about 3° from the bisectrix W between the two straight folding edges 10 of the pocket support plate 6 which are adjacent to one another. FIG. 5 shows in solid lines the pivoted position of the cylinder 38 located on the right in FIG. 2. Due to the fact that the piston rod 48 is extended in the left-hand short-stroke cylinder 47 and the piston rod 48 is withdrawn in the right-hand short-stroke cylinder 47, the round folding slide 9 is in such an angular position that in the starting position, the right-hand end 51 of the concave folding edge 49 has a shorter distance from the convex folding edge 11 of the pocket support plate 6 than the left-hand end 50. The consequence of this is that the transition area between the straight and round edge sections R of the pocket cut T, which transition area is located opposite the end 51, is folded over first during the forward movement of the round folding slide 9 into the folding position before the rest of the area of the round edge section R is folded over as well. A comparatively intense folding effect, by which a uniformly extending folded edge is obtained in this problematic area of the pocket T, is thus exerted on the transition area of the edge section R.

After all folding slides 8, 9 have reached their folding positions, the pocket support plate 6 and the pressing plate 7 together with the folding slides 8, 9 are lowered together to the extent that the folding slides 8, 9 will lie on the piece of clothing. Then, only the round folding slides 9 are withdrawn from their folding positions, pivoted into the angular position indicated by dash-dotted lines in FIG. 5 by admitting pressure into the two short-stroke cylinders 47 in the opposite direction and then again moved forward into the folding position. Since the left-hand end 50 of the concave folding edge 49 now has a shorter distance from the convex folding edge 11, an intense folding effect is now exerted on the other transition area of the same round edge section R, as a result of which a bulge of the pocket folded edge that may have formed during the first folding operation is folded in correctly.

The folding effect of the respective ends 50 and 51 of the concave folding edges 49, which ends are first engaged, is also supported by the fact that the movement of the round folding slides 9 takes place in relation to the straight edge section 10 adjoining the transition area in a direction corresponding to an angle that is steeper by the amount of the angular position of the respective cylinder 38 than if the round folding slide 9 were moved as usual in the direction of the bisectrix W.

The notches 52 of the round folding slides 9, which are provided at uniform distances, cause the creases, which are inevitably formed during the folding over of round edge sections as a consequence of the material gatherings occurring in the process, to be distributed uniformly over the circumference of the round edge sections, as a result of which the creases will also become more uniform among one another. Thus, the notches 52 also contribute to the uniform distribution of the material gatherings occurring in the area of round edge sections.

The folding over of the pocket cuts T takes place with the pressing plate 7 heated by means of the two heating cartridges 37. An ironing effect, which causes the shape and the position of the folded edges of the pocket to be permanently pressed flat, is generated by the combination of pressure and heat, and the result of the folding is thus additionally improved.

After the conclusion of the second folding operation of the two round folding slides 9, all folding slides 8, 9 are again returned into their starting position. The pressing plate 7 together with the folding slides 8, 9 is then raised from the folded pocket cut T to the extent that the fabric holder 4 can then be lowered onto the part of the folded pocket cut T located on the pocket support plate 6. A pulling force directed toward the middle of the pocket is applied to the folded edges of the pocket by one or more obliquely projecting foam strips, which are arranged on the underside of the fabric holder 4 and are flatly in contact with the underside of the fabric holder 4 when the fabric holder 4 is put on. This additionally contributes to pulling the folded edges of the pocket tight and to a further improvement of the result of the folding.

After the fabric holder 4 has grasped the folded pocket cut T, the pocket support plate 6 is pulled back into its starting position, after which the fabric holder 4 moves the piece of clothing to the sewing machine 2 together with the pocket cut T lying thereon.

In the second exemplary embodiment according to FIG. 6, the two found folding slides 53 perform a single folding movement together with the straight folding slides 8, which movement takes place in parallel to the bisectrix W in this case. Since the two ends 55 of the concave folding edge 54jut out in relation to the middle area of the folding edge in each of the two round folding slides 53, a folding effect that begins sooner and is therefore stronger is exerted simultaneously on the two transition areas from the round edge sections to the straight edge sections of the pocket cut T during the forward movement of the round folding slides 53 compared with the folding effect on the middle area of the round edge sections. This is illustrated by the different positions of the round folding slide 53 indicated by dash-dotted lines in FIG. 6. It is thus also ensured in the second exemplary embodiment that a uniformly extending pocket folded edge is obtained over the entire course of the round edge sections.

While specific embodiments of the invention have been shown and described in detail to illustrate the application of the principles of the invention, it will be understood that the invention may be embodied otherwise without departing from such principles.

What is claimed is:

1. A process for folding, or folding over edges of pocket cuts with round edge sections during the preparation of pockets sewn on pieces of garments, the process comprising the steps of:

using a folding device arranged on a sewing unit with a pocket support plate, which can be moved up and down as well as forward and backward in relation to a said fabric support plate, and with a pressing plate, which can be moved up and down, as well as with a plurality of folding slides, which can be moved up and down together with the pressing plate and can be moved forward and backward individually or together, of which the round folding slides used to form the round edge sections have a concave folding edge; and during a forward movement into the folding position of the round folding slides, leading the movement with at least one of the two ends of the concave folding edges in relation to the middle area of the folding edges.

2. A process in accordance with claim 1, wherein the round folding slides are movable into the folding position in two different directions of movement extending at an acute angle in relation to one another, to provide that the concave folding edges assume an asymmetric position each in relation to the convex folding edge of the pocket support plate and wherein the first folding movement of the round folding slides takes place essentially simultaneously with the forward movement of the other folding slides into the folding position, and wherein the second folding movement of the round folding slides takes place after the folding slides have been lowered onto the piece of garment.

3. A folding device, comprising:

a fabric support plate;

a pocket support plate; said support plate being movable up and down as well as forward and backward in relation to said fabric support plate;

a pressing plate, said pressing plate being movable up and down; and a plurality of folding slides, said folding slides being movable up and down together with said pressing plate and being movable forward and backward, said folding slides including round folding slides used to form round edge sections, said round folding slides each including a concave folding edge with two ends, said round folding slides each being movable with at least one of said two ends of the concave folding edges leading, during the movement, in relation to a middle area of the folding edges.

4. A folding device according to claim 3, wherein said at least one of said two ends of the concave folding edges lead in relation to a middle area of the folding edges during movement with at least one said end of the concave folding edges of the round folding slides having a shorter distance from the respective associated convex folding edge of the pocket support plate than the middle area of the of the concave folding edges.

5. A folding device in accordance with claim 4, wherein the two ends of the concave folding edges of the round folding slides have a shorter distance from the respective associated convex folding edge of the pocket support plate than the rest of the area of the concave folding edges.

6. A folding device in accordance with claim 5, wherein the concave folding edges of the round folding slides have a smaller radius than the associated convex folding edges of the pocket support plate.

7. A folding device in accordance with claim 3, further comprising:

an adjusting device; and compressed air cylinders used to move the round folding slides forward and backward and, said compressed air cylinders respectively carrying respective said round folding slides, each of said compressed air cylinders being mounted pivotably around an axis extending at a right angle to a path of movement of the associated round folding slide, each of said compressed air cylinders being movable into one of two alternative pivoted positions by said adjusting device.

8. A folding device in accordance with claim 7, wherein said adjusting device is formed by two short-stroke cylinders arranged opposite each other and to which pressure can be alternatingly admitted.

9. A folding device in accordance with claim 8, wherein each of said round folding slides have a plurality of essentially radially extending notches.

10. A folding device in accordance with claim 3, wherein said pressing plate has a surface facing said pocket support plate with a shape adapted to a cross-sectional shape of said pocket support plate, said cross-sectional shape being flattened toward edges of said pocket support plate.

11. A folding device in accordance with claim 3, further comprising: an electromagnet associated with said pressing plate.

12. A folding device in accordance with claim 3, wherein said pressing plate is provided with a heating device.

13. A folding device in accordance with claim 3, further comprising:

springs; and a carrier movable in a direction at right angles to a pressing surface of said pressing plate, said pressing plate being arranged on said carrier and being supported in relation to said carrier via said springs.

* * * * *